United States Patent [19]

Ha

[11] Patent Number: 4,602,728

[45] Date of Patent: Jul. 29, 1986

[54] CONTAINER

[76] Inventor: Sung M. Ha, 5411 Golden West Ave., Temple City, Calif. 91780

[21] Appl. No.: 712,259

[22] Filed: Mar. 15, 1985

[51] Int. Cl.[4] ..... B65D 25/44

[52] U.S. Cl. ..... 222/528; 222/530

[58] Field of Search ..... 222/527, 528, 529, 572, 222/530

[56] References Cited

U.S. PATENT DOCUMENTS

| | | | |
|---|---|---|---|
| 3,690,522 | 9/1972 | Chlyston | 222/529 |
| 3,976,277 | 8/1976 | Basel et al. | 222/529 |
| 4,073,413 | 2/1978 | Tabler et al. | 222/529 |
| 4,095,728 | 6/1978 | Chlyston | 222/529 |
| 4,428,498 | 1/1984 | Obey | 222/527 |
| 4,452,382 | 6/1984 | Von Holdt | 222/529 |

FOREIGN PATENT DOCUMENTS

| | | | |
|---|---|---|---|
| 688545 | 3/1953 | United Kingdom | 222/527 |

*Primary Examiner*—John E. Kittle
*Assistant Examiner*—James J. Seidleck
*Attorney, Agent, or Firm*—Christie, Parker & Hale

[57] ABSTRACT

A container is set forth which includes a neck adapted to assume a collapsed position and to be extended in a bellows or telescopic fashion to an extended position for dispensing of a fluid or a pourable solid. The container may include a spout having a flexure portion which can be squeezed closed to prevent the fluid or solid from passing through the spout.

3 Claims, 7 Drawing Figures

CONTAINER

FIELD OF THE INVENTION

This invention relates to containers and more particularly to containers adapted for pouring their contents into difficult, hard to reach openings or the like.

BACKGROUND OF THE INVENTION

Containers provide a convenient manner by which to store and dispense fluids. A good example is automotive lubricating oil. Traditionally, the oil was stored in cylindrical quart or 5-quart cans of the type having a metallic top and bottom with a metal or composite paper or cardboard side wall. To dispense the contents one of the metallic ends was opened and the oil was poured from the can.

Once opened, it was necessary to pour the oil into the oil fill opening usually located on the engine valve cover. Hoses or other components of the engine or accessories may be located adjacent the opening thereby preventing the mechanic or car owner from positioning the can sufficiently close to the opening to easily pour the oil into the opening. Funnels have been used to facilitate the pouring of oil into the opening.

In lieu of using funnels, it has been known to provide devices which function not only to open the can but also as a spout. These devices are common and include opening means having a penetrating blade and a curved spout adapted to be received into the oil fill opening. Upon opening of the can the device becomes attached to the can and may be handled as a unit.

Recently, the traditional oil can and other similar containers have been replaced by plastic bottles. These bottles are not adapted to be used with the spout devices and therefore the problem of pouring the oil into the oil fill opening persist. This problem is enhanced particularly with modern automobiles whose engines are closely fitted within the compartment and due to the myriad of accessories such as air conditioning, power-steering and the like associated with the engine. It has been found difficult to use these modern oil containers for pouring of lubricating oil into the engine.

SUMMARY OF THE INVENTION

There is, therefore, provided according to the present invention a container having a reservoir adapted to retain a selected amount of fluid. A neck is connected at one end to the reservoir and has at the other end an outlet from which the fluid is dispensed. The neck is extensible, that is, it is adapted to assume a collapsed position giving the container a profile suitable to storage and shipment and is extendible in a telescopic of bellows fashion to an extended state to locate the outlet remote from the reservoir for pouring of the fluid therefrom through the desired opening. By providing the extendible neck the container can be transformed to easily pour the fluid therefrom into the desired opening.

Preferably, the neck extends a distance sufficient to enable the outlet to be positioned in the fluid fill opening.

Toward this end, and more specifically, the extendible neck is fashioned somewhat like a conical bellows having connected at one end a spout having the dispensing outlet therein. To dispense the fluid from the reservoir, the spout is pulled causing the bellows-type neck to expand facilitating the pouring of the fluid through the neck and spout into a fluid fill opening. In a further embodiment of the invention, the spout may include a flexure portion which may be grasped between, for example, the thumb and forefinger and squeezed together to prevent the fluid from flowing through the outlet. In this fashion, a person may extend the neck, squeeze the flexure portion to a closed position, invert the container and locate the outlet in the desired fill opening. Once located, the flexure portion is released permitting the fluid to pass from the container.

As can be appreciated, the container according to the present invention enables an individual to pour the fluid into particularly hard to reach fill openings. The extensible neck transforms into an elongate funnel to direct the fluid to the outlet. It should be noted that the bellows-type neck is somewhat flexible to turn the outlet for location in the fill opening. Further, the bellows-type neck defines a series of concentric grooves to engage the bounds of the fill opening to hold the spout and outlet in position.

BRIEF DESCRIPTION OF THE DRAWINGS

These and other features and advantages will become appreciated as the same become better understood with reference to the specification claims and drawings wherein:

DETAILED DESCRIPTION

Figure 1:
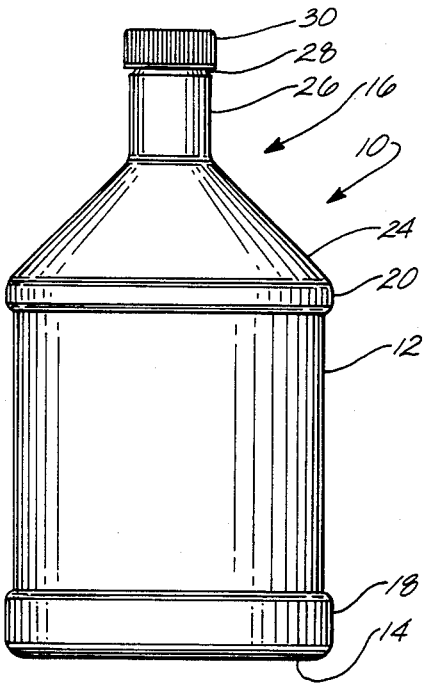
Fig. 1. PRIOR ART
FIG. 1 is a side view of a container according to the prior art.

Turning to the drawings, FIG. 1 shows a container 10 according to the prior art for storing and dispensing a fluid which may be automotive lubricating oil, transmission fluid, brake fluid, coolant or any other fluid or perhaps toner for photocopy machines. While the description hereinafter set forth is directed toward a container for storing and dispensing automotive lubricating oil it is to be understood that its teachings are equally applicable to other fluids and pourable solids.

The container 10 is typically fashioned from a hard plastic and is molded to have a reservoir portion 12 having a bottom 14 and a rigid top generally shown as 16. The reservoir portion 12 may be molded to have a bottom rim 18 and a top rim 20. Each of the aforesaid bottom and top rims 18 and 20 projects outwardly creating therebetween a surface 22 for grasping of the container in one's hand. Each of the rims are convenient to prevent the container from slipping from the hand.

The rigid top 16 includes a conical neck 24 at the frustum of which is connected a spout 26. The spout 26 has a diameter suitable for being received in an accommodating fill opening (not shown) such as the oil fill opening on the valve cover for an automobile engine. The spout 26 opposite the neck 24 terminates at an outlet (not shown) through which the oil from the container 10 is poured into the engine. Threads 28 are provided about the exterior of the spout 26 adjacent the opening to threadably receive a cap 30 to close the opening.

In use, the cap 30 is removed from the spout 26 as is the cap at the fill opening. The container 10 is grasped about the surface 22 and is simultaneously directed and inverted so as to locate the spout 26 within the fill opening.

A problem which has occurred in use of the container 10 is that once the container is inverted the oil necessarily begins to flow from the outlet. This flow may occur before the spout 26 is suitably positioned causing the oil to be spilled over the engine block or adjacent components and hoses. A further problem has been that the fill opening for the engine may be located such that the spout 26 cannot in fact be received into the fill opening. Accordingly, it may be necessary to use a separate funnel for pouring the oil into the fill opening.

Figure 2:
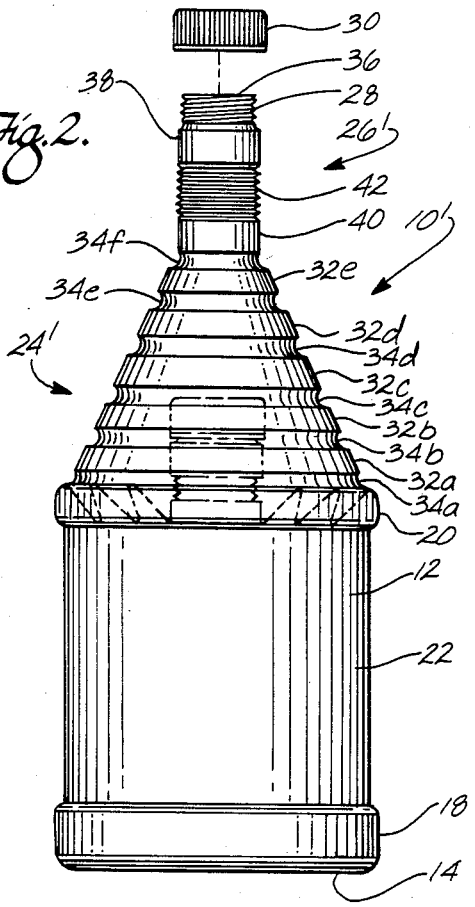
FIG. 2 is a side view of one embodiment of the container according to the present invention shown with the neck in the expanded state and illustrating, in phantom, the neck in the collapsed state.
Figure 3:
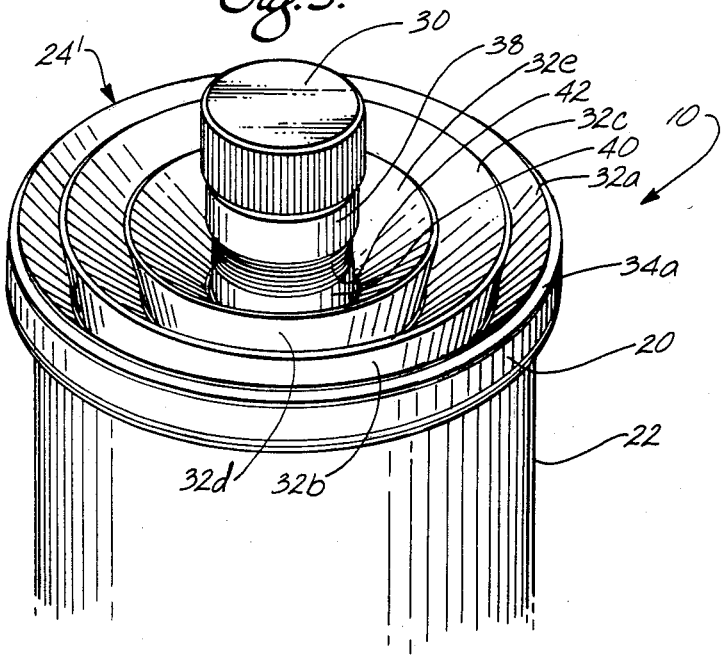
FIG. 3 is a perspective top view of the container with the neck in the collapsed state.
Figure 4:
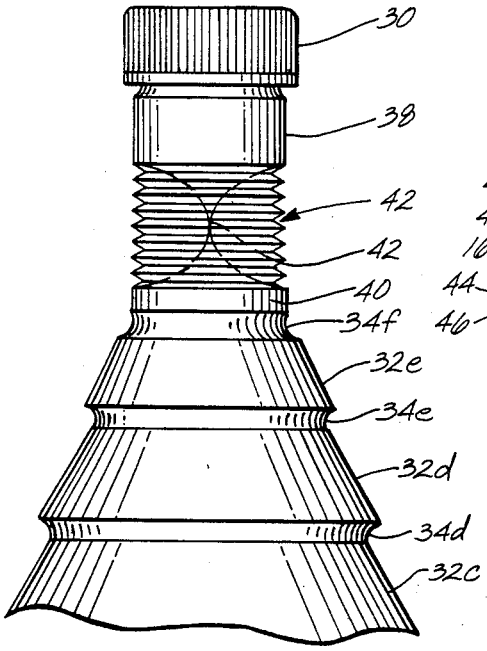
FIG. 4 is an enlarged view of the neck of FIGS. 2–3 in the extended position illustrating the container spout and a flexure portion therefor for closing the spout.

Turning to FIGS. 2–4, an embodiment of a container 10' according to the present invention is shown. Those components which are similar to those discussed above with reference to the prior art container 10 will carry the same reference numerals. Container 10' has a reservoir 12 having a bottom 14 and a top 16'. Bottom and top rims 18 and 20 may also be provided to define the surface 22 for grasping of the container 10' in one's hand.

The container 10' is preferably constructed from a plastic and is molded such that the top 16' includes a neck 24' constructed according to the present invention. The neck 24' is adapted to be extendible from a collapsed position (as shown in FIG. 3 and in phantom in FIG. 2) and to be extended to the extended position as shown in FIGS. 2 and 4. To accomplish the foregoing, the neck 24' is fashioned somewhat as a conical bellows including a plurality of relatively rigid, concentric rings of decreasing diameters shown as rings 32*a–e* which are interconnected to the adjacent ring and reservoir portion 12 by flexible joints 34*a–f*. Joint 34*f* connects the neck 24' to a spout 26'. While the rings 32*a–e* are somewhat flexible, the joints 34*a–f* are more flexible thereby permitting the neck 24' to be collapsed in a bellows or telescopic fashion to a collapsed position and to be extended to the extended position as shown in FIG. 2. To accomplish the foregoing, the container 10' may be molded such that the wall thickness at each joint is relatively thin and therefore flexible. Flexibility not only enables the neck to extend but also is convenient in that the neck may be bent from side to side to properly locate the spout 26'.

While the spout may be rigid along its length, means for blocking fluid flow through the spout may be provided. As shown in FIGS. 2 and 4 these blocking means are preferably embodied as a flexible closure portion 42 disposed medially along length of the spout 26'. The closure portion 42 defines a rigid collar 38 and a base 40 at either side of the portion, the collar 38 being suitable for being grasped along with the cap 30. The closure portion 42, as shown in FIG. 2, and more particularly FIG. 4, may be molded in the fashion of a bellows and has a relatively thin wall so that from its open position, as shown by the solid line in FIG. 4, the closure portion 42 may be squeezed to the closed position shown by the phantom line in FIG. 4. The squeezing of the closure portion 42 may be as via the thumb and forefinger of the container user's hand.

Turning to FIG. 3, the container 10' is shown with the neck 24' in the collapsed position. In the collapsed position, the neck 24' assumes a flat orientation. Of couse, it is to be understood that the arrangement of the rings 32 and joints 34 may yield, in the collapsed state, a neck 24' having a somewhat conical shape. As shown, the flexible joints 34 are flexed such that the rings 32*a–e* somewhat overlay one another. The spout 26' projects axially upward from the collapsed neck 24' with the closure portion 42 also somewhat collapsed to provide a compact profile for the container 10' for storage and shipment.

When the contents of the container 10' are to be dispensed the cap 30 is loosened to admit air into the container 10' to permit the neck 16' to be extended. The neck 16' may be fashioned to maintain its collapsed position by virtue of the construction of the neck and the interaction of the rings and joints. In lieu of or in addition to this construction, the collapsed state may be maintained simply by sealing the cap 30 so that when the container 10' is upright, the neck cannot extend since the increased volume of the container 10' cannot be filled by air. After the cap 30 has been loosened, the spout 26' is grasped at the cap 30 and/or collar 38 and is pulled upwardly causing the neck 24' to extend in a telescopic fashion to the position shown in FIG. 2, which locates the spout 26' and its outlet 36 remote from the container reservoir portion 12. Thereafter, the container may be positioned and inverted to dispense the contents through the neck 24', spout 26' and its outlet 36 into a suitable fill opening. Preferably, in its extended state, the top 16' for the container 10' extends a greater length than the top 16 according to the prior art containers 10. Should the fill opening be difficult to locate the user may grasp and squeeze the closure portion 42 closed preventing the oil from being dispensed from the container. The container 10' is then inverted and positioned such that the spout 26' is located in the fill opening. Releasing the closure portion enables the oil to flow therethrough and into the fill opening. As an added feature, the grooves defined by the bellows-type closure portion 42 are adapted to cooperate with the bounds of fill opening to hold the spout 26' and container 10' in the desired position for dispensing of the fluid into the fill opening.

Figure 5:
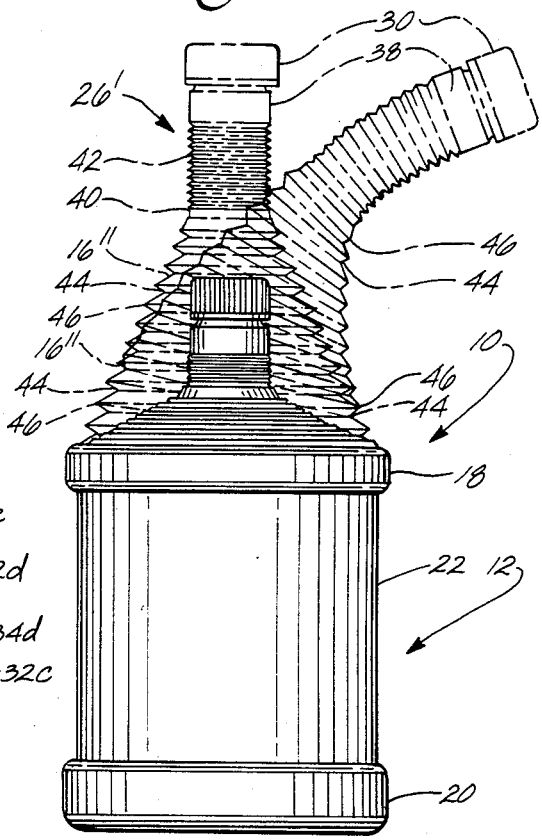
FIG. 5 is a side view of another embodiment of the container illustrating in phantom the flexible nature of the neck.

Turning to FIG. 5, a further embodiment of the container 10' according to the present invention in shown. This container 10' has a reservoir portion 12 which may be of the type described above. Secured to the reservoir portion 12 is a neck 16'' which terminates at a base 40. A closure portion 42 extends from the base 40 to collar 38 for the spout 26'. A cap 30 is threaded over threads 28 (not shown) to close the spout. The neck 16'' is accordion-like including flexible valleys 44 joined by ridges 46. As can be appreciated, the accordion-like neck 16'' can be collapsed as well as can the closure portion 42 so that the neck 16'' and spout 26' assume the collapsed position as shown in FIG. 5. The neck 16'' can also be extended to the extended position shown in FIG. 5. To accomplish the foregoing, the wall thickness of the neck 16'' may be relatively thin and may be such that when it is expanded the neck assumes and maintains its expanded position until forcibly collapsed.

To extend the neck 16'' and spout 26', the user grasps the cap 30 or collar 38 and pulls causing the neck 16'' to extend in accordion-like fashion to the extended position as shown in FIG. 5. Further, the accordion-like neck 16'' can be bent to locate the spout outlet 36 as desired. The closure portion 42 is also available to function in the manner described above. Accordingly, the embodiment as shown in FIG, 5, like the embodiment described above, enables the neck 16'' to be extended for location of the spout 26' in the appropriate fill opening.

Figure 6:
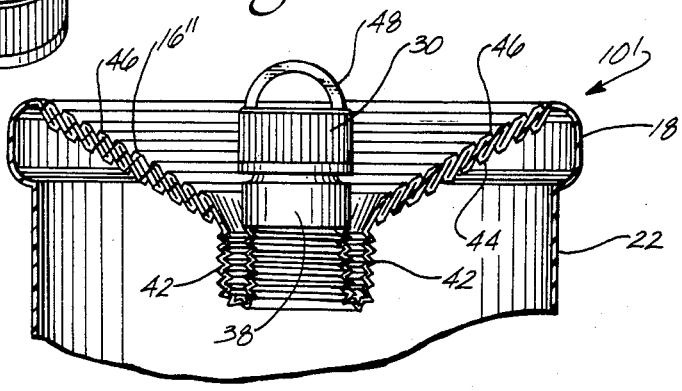
FIG. 6 is a partial section view of the container according to another embodiment shown with the neck in the collapsed position.

Turning to FIG. 6, a further embodiment of the container 10' according to the present invention is shown. Unlike the previous embodiments, the container of FIG. 6 is adapted to, when the neck shown as 16'' is collapsed, receive the spout and cap to a concealed position. According to this embodiment, the neck 16'' is much like that described with reference to FIGS. 2–4, or may be of the accordion-type as shown in FIG. 5. From the neck 16' the closure portion 42 extends directly to the collar 38. When the neck 16'' is collapsed, the spout may be pushed inwardly into the reservoir portion 12' to a concealed position as shown in FIG. 6. In this position, the spout, and more particularly the closure portion 42, is folded back upon itself so that the cap 30 may be received within the neck 16''. Depending upon the configuration of the neck 16' and cap 30 may advantageously give the container 10' a low profile well suited for storage, stacking and shipment.

Figure 7:
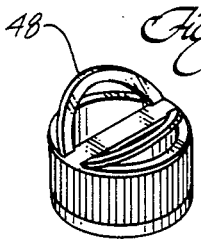
FIG. 7 is a perspective top view of an embodiment of a cap for the container of FIG. 6.

To extend the neck 16', the cap 30 may be provided with a lift-up loop 48 (FIG. 7) which can be grasped by the user's finger to initially pull the spout from its concealed position. Once the spout has been extended to project above the collapsed neck 16'', the extension of the neck may be created by loosening the cap 30 and pulling the loop 48, cap 30 or collar 38. Once in the extended position, the container 10' operates in the manner described above to facilitate dispensing of the fluid therefrom.

The container 10' is preferably molded from a hard plastic as well is the neck 16' and 16'. Preferably, as stated above, the plastic and its thickness at the neck is adapted so that when the neck is extended it remains in that position until forcibly collapsed. That is, during the extension of the neck, the joints or valleys at least temporarily assume the neck extended configuration thereby preventing the neck from simply collapsing when released.

While I have shown and described certain embodiments of the present invention, it is to be understood that it is subject to many modifications without departing from the spirit and scope of the invention set forth herein.

What is claimed is:

1. A container comprising:

a reservoir having at one end a bottom and at the other end a peripheral rim, the reservoir adapted to hold fluid;

a conical bellows neck joined at one end to the rim and having at the other end a spout for dispensing fluid, said neck including a plurality of ring-shaped plates joined by annular flexible joints, said neck extendable from a collapsed position where said joints fold back upon themselves to arrange the plates in a an overlapping fashion to an extended position where the joints are unfolded and the plates are located to define a funnel configuration to guide fluid from the container to the spout; and said spout includes a bellows-like closure portion adapted to be squeezed in the hand from an open position to a closed position to control the dispensing of fluid.

2. The container of claim 1 wherein the plates and joints cooperate to maintain the neck in the extended position.

3. The container of claim 1 further including a cap removably disposed on the spout, said bellows neck and closure collapsing upon themselves to locate said cap at a position substantially flush with the rim to provide for stacking of said containers.

* * * * *